US006253827B1

(12) United States Patent
Kaneto et al.

(10) Patent No.: US 6,253,827 B1
(45) Date of Patent: Jul. 3, 2001

(54) METHOD OF COMPRESSING MOLDING SAND USING INDEPENDENTLY CONTROLLED GAS GUIDING PIPES

(75) Inventors: Kimikazu Kaneto; Minoru Hirata, both of Toyokawa (JP)

(73) Assignee: Sintokogio, Ltd., Aichi Prefecture (JP)

( * ) Notice: Subject to any disclaimer, the term of this patent is extended or adjusted under 35 U.S.C. 154(b) by 0 days.

(21) Appl. No.: 09/302,936

(22) Filed: Apr. 30, 1999

(30) Foreign Application Priority Data

Oct. 28, 1998 (JP) ..... 10-307307

(51) Int. Cl.[7] ..... B22C 15/28; B22C 15/24

(52) U.S. Cl. ..... 164/38; 164/200; 164/195; 164/29

(58) Field of Search ..... 164/38, 200, 195, 164/29

(56) References Cited

FOREIGN PATENT DOCUMENTS

| | | | | |
|---|---|---|---|---|
| 44 09 791 | * | 3/1994 | (DE) . | |
| 44 09 791 A1 | | 3/1994 | (DE) | B22C/15/08 |
| 0 263 977 | * | 12/1991 | (EP) . | |
| 0 263 977 B1 | | 12/1991 | (EP) | B22C/15/28 |
| 6-277800 | * | 10/1994 | (JP) | 164/200 |

* cited by examiner

*Primary Examiner*—Nam Nguyen
*Assistant Examiner*—I.-H. Lin
(74) *Attorney, Agent, or Firm*—Gray Cary Ware & Freidenrich LLP

(57) ABSTRACT

A method of compacting molding sand by using separated and independently controlled gas guiding pipes that are arranged over horizontally spaced locations of the entire surface of the molding sand. This enables independent compression of different features within the mold model and minimizes the energy consumed for compressing molding sand.

5 Claims, 1 Drawing Sheet

METHOD OF COMPRESSING MOLDING SAND USING INDEPENDENTLY CONTROLLED GAS GUIDING PIPES

BACKGROUND OF THE INVENTION

1. Field of the Invention

This invention is a method of compressing molding sand and an apparatus for compressing molding sand. More specifically, this invention is a method of compressing molding sand by blowing compressed gas through a plurality of compressed gas conductors onto the entire surface of molding sand inserted within a molding frame that is separated from a model but that encloses its sides. The frame and the model are both placed on a molding plate that is provided with a vent for exhaust.

2. Background Information

Many methods and apparatuses in this technical field are publicly known. For instance, EP No. 0263977 teaches a device in which molding sand inserted within a molding frame encloses a model from its sides, and to compress the molding sand a squeezing device is provided above the molding frame, the squeezing device and the molding frame being complementary to each other, said squeezing device comprising a plurality of squeezing members and compressed gas pipes.

In that device compressed gas is blown onto the molding sand at a uniform flow rate through compressed gas pipes so that the gas is simultaneously blown onto the molding sand through all compressed gas pipes of the squeeze device and flows into the sand. Then the molding sand is pressed mechanically by the squeezing members. In this way the mold is compressed uniformly within the molding frame.

But by using the above prior art, especially when forming a mold using a model consisting of sections with a great difference in their heights, compressing the higher sections and lower sections of the model to give a mold that precisely conforms may cause a part of it, e.g., a protruding part of it that corresponds to a pocket section of the model, to break during the time the completed mold is released from the molding frame after the compression is over.

This invention is designed to overcome such a problem. This invention aims to provide a method and an apparatus to compress molding sand so that different parts of the mold are compressed independently from the other parts and to minimize the energy consumed for compressing molding sand.

SUMMARY OF THE INVENTION

The method of compression of this invention comprises the steps of placing a model and a molding frame on a model plate provided with an exhaust vent, said molding frame being spaced away from, and enclosing, the model, pouring molding sand to fill the space within the molding frame, and blowing compressed gas through a plurality of compressed gas pipes over the upper surface of the molding sand within the molding frame, characterized by blowing the gas from said plurality of compressed gas pipes in such a way that each pipe can be independently closed or independently placed under pressure control.

In contrast to the prior art, by using the method of this invention, the model can be compressed such that various sections of the mold are compressed to various degrees by blowing compressed gas onto specific parts of molding sand in predetermined degrees of strength.

The molding sand compression apparatus of this invention is provided with independent compression gas pipes arranged over substantially the entire surface of the molding sand. It also has a mechanism in which compressed gas blown out from at least some of compressed gas pipes is independently controllable.

DESCRIPTION OF THE PREFERRED EMBODIMENTS

Figure 1:
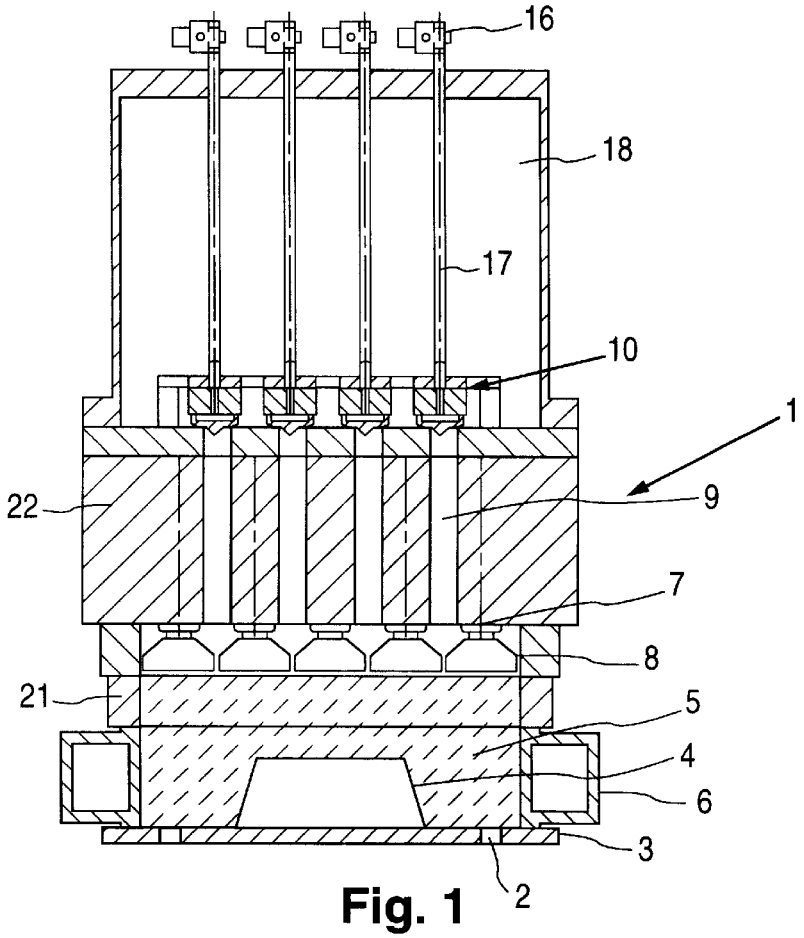
FIG. 1 is a side cross-sectional view of an embodiment of the inventive apparatus for compressing Brief Description of the molding sand.

One embodiment of the invention is an apparatus for compressing molding sand comprising a pipe device 1 with a top surface and a bottom surface and provided with a plurality of compressed gas pipes 9 that run therethrough and are provided with openings on the top surface and the bottom surface, a compressed gas container 18 that communicates with the openings on the top surface of said compressed gas pipes 9, an opening valve 10 provided at each of the openings of the top surface of said compressed gas pipes 9 to close or open said openings by adjusting pressure working on the valve, the pressure being independent of the pressure of the compressed gas within the container 18, and a control valve 16 operatively connected to each of the opening valves 10 to open them by reducing the pressure working on the opening valve to a level that is lower than the pressure of the compressed gas within the container 18.

By using this device, the different parts of the mold provided within the molding frame can be independently compressed to different degrees.

Therefore, even of the model is complex in shape, the most preferred local compression will be caused. As needed, the strength of various parts of the mold can be freely selected from various choices. Thus, the mold can be released from the model without any adverse effect on the mold. Any damage caused from separation of the mold from the model, such as a protruding part of the mold that corresponds to a pocket section of the model breaking, can be definitely avoided.

By this invention, the energy consumed for compression can be greatly reduced compared to the prior art. This effect is cause by controlling the pressure of the compressed gas blown onto the parts of the molding sand, wherein no strong compression rate is required.

In a most effective sample of this invention, a plurality of or a group of openings are orderly controlled by different strengths of compressed gas, and this causes a uniform compression throughout the process, and the level of the pressure inside the mold can be controlled to various degrees.

When each compressed gas opening that is provided on an opening area or on an end of each compressed gas pipe is controlled by the operation of a valve piston, it becomes very easy to control parts of or entire openings. Thus, the openings can be effectively and easily adjusted. Preferably, when each opening or a group of openings are controlled by various pressures, or by various volumes and flow rates of compressed gas, or both, the method of this invention will assure unrestricted variations of the degree of compression in different parts and in wide ranges. Unexpectedly, using a plurality of lightweight valve pistons of this invention enables the entire compression to be carried out in various, and in a wide range of, ways, because lightweight valves have a high mobility. Also, if the valves are lighter, the noise caused by the apparatus can also be reduced. Clearly, all the valves can also be simultaneously operated in the same way.

It might be easily considered that a mold can be produced by merely controlling the compressed gas openings by using compressed gas and compressing molding sand thereby. However, using squeezing members in addition to such a device will be highly effective and increase the degree of compression.

When squeezing members are used, it is preferable to operate the squeezing members while, or after, the gas blowing from the openings for compressed gas is controlled. This not only causes the squeezing members to carry out fine pre-compression of the molding sand to a predetermined degree, but also enables a subsequent compression step to be carried out by the use of squeezing members driven by oil pressure, which can generate high pressure.

In a simple form, all the squeezing members are uniformly designed and operated in the same way. By this, the squeezing members can apply uniform compression to the mold. However, to accelerate applying various degrees of compression to various parts of the mold by controlling the degree of compression by the compression gas, each squeezing member or a group of squeezing members are preferably arranged to generate independent compression.

To make a mold that precisely conforms to the model, it is considered to adjust the compressed gas openings that correspond to the parts that are difficult to produce a mold, independently of the other openings. However, it is most preferable to enlarge the range of compression by the apparatus of this invention and to independently control the compression gas blown from each opening. By doing so, the device of this invention can provide preferable compression to the parts near edges of, or to any relevant parts of, the mold.

Effective embodiments of this invention can decrease the cost and simply the structure of the compression apparatus. At least one opening valve to control the compressed gas is provided on the parts of openings or the pipes of the openings that are controlled by those opening valves independently. It is most preferable if compressed gas openings are provided with opening valves at the opening areas or at compressed gas pipes. This will enable flexible use of the apparatus according to the required conditions.

It is preferable for the safety of the construction and motion of the valves to provide a controllable valve piston for each opening valve.

According to the most preferable embodiment of this invention, each valve piston contains an inclined ring surface at a transitional section between its side wall and a piston head facing the exhaust side of the valve. This results in the smooth control of the valves by controlling the inner spaces of the valve pistons to have a lower pressure than the pressure maintained by compression gas ports (each gas port is preferably a pressure container provided around each, or around a part of each, opening valve). The effect caused by the compressed gas acting on the ring surface at the external surface of the piston results in an easy and quick opening of each valve. As the ring surface at the external edge of the valve piston head is inclined, when the gas in the inner space of the valve piston is discharged while the valve is subjected to the compressed gas the valve readily opens.

If the surface of the head of the valve piston facing the exhaust side of the valve is shaped so that the area between the outermost end of the head and the periphery of the head is concave, the outermost end of the head being symmetrically positioned relative to the center of the piston, a laminar flow of the compressed gas will be caused through the compressed gas openings.

According to another preferred embodiment of this invention, each squeezing member can be independently controlled to carry out the suitable degree of compression corresponding to the purpose predetermined for the model. Furthermore, in addition to the pressure containers provided above the pipe device and commonly communicating with the plurality of openings at the top edges of compressed gas pipes, one or a plurality of independent pressure containers can be provided so that they are made to communicate with one or a few compressed gas pipes. Each added pressure container can be operatively connected to opening valves communicating with control valves that reduce pressure to cause a lower pressure at the space within the opening valves than that of the main pressure container. By using such a structure, just the four corners of the molding frame, for instance, can be compressed independently of the remaining parts of the mold.

Figure 2:
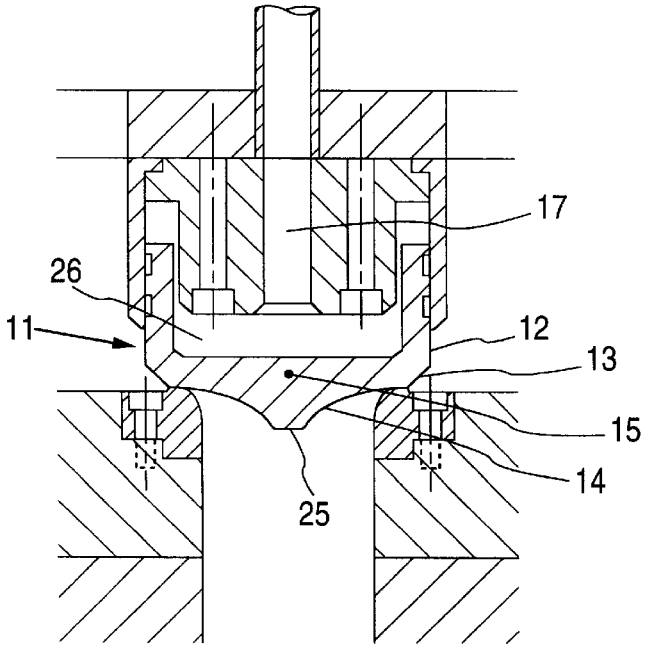
FIG. 2 is a more detailed view of a portion of FIG. 1, showing one of opening valves 10.

This invention has a plurality of embodiments. Below, this invention is explained by referring to the attached drawings. FIG. 1 is a cross-sectional view of the apparatus of an embodiment of this invention for compressing molding sand, viewed from one side of the apparatus. FIG. 2 is an enlarged view of the valve piston of FIG. 1.

As shown in FIG. 1, the apparatus of this embodiment comprises a model plate 3 on which the model 4 is provided. Model 4 (sometimes referred to as a pattern) is provided inside the molding frame 6 (sometimes referred to as a flask) that is also provided on the model plate 3 (sometimes referred to as a pattern plate). Molding sand 5, which is placed within the molding frame or flask 6, surrounds the model 4. The model plate 3 comprises an exhaust vent 2 at an area near an edge of the plate.

A chamber 22 of a pipe device 1 is provided above a filling frame 21 that is provided above the molding frame 6. The molding sand 5 can be placed within the filling frame 21 and the molding frame 6. The chamber 22 is provided above the filling frame 21 in a pressure-sealed condition. The filling frame 21 is also connected to the modeling frame 6 and model plate 3 in a pressure-sealed condition.

The chamber 22 communications, for example, with a pressure container 18 that is filled with compressed gas, such as compressed air, at an end opposite to the end that faces the filling frame 21 and molding frame 6. The pressure container 18 adjoins the squeezing device 1. The pipe device 1 comprises compressed gas pipes 9 (sometimes referred to as gas guiding pipes), each provided with a compressed gas opening 7 and a squeezing member 8, and a plurality of squeezing mechanisms comprising plunger pistons that are not shown in the drawing.

Compressed gas is directly supplied from the pressure container 18 into the compressed gas pipes 9. In doing so, opening valves 10, which are provided at the bottom part of the pressure container 18, control the flow of the compressed gas from the openings 7. Each opening valve 10 comprises a valve piston 11 that is pneumatically controlled by a control valve 16 through a controlling pipe 17. The valve pistons 11 can be controlled independently from one another.

To clearly explain the structure of the opening valve 10, FIG. 2 shows enlarged details of the opening valve shown in FIG. 1. In FIG. 2 the valve piston 11 is U-shaped in cross section and comprises a side wall 12 and a bottom section 15. The transitional section between the side wall 12 and the bottom section 15 forms an inclined ring surface 13 [18]. The bottom surface 14 faces toward the exhaust side of the valve 10 and is shaped concavely and converges to the lowest section 25 of the valve piston 11.

It is preferable to place the pipe device 1 so as to be able to have it be slidably adjusted in a vertical direction, so that the pipe device 1 can be placed on top of the filling frame 21 and be removed after compression is completed. Providing the pipe device 1 on the filling frame 21 before the squeezing process occurs will cause a tight connection between the pipe device 1, filling frame 21, molding frame 6, and model plate 3. This tight connection forms a pressure-seal between them.

By using the control valves 16 and controlling pipes 17 to decrease pressure within the inner space 26 of each valve piston 11 to a level lower than the pressure in the pressure container 18, the valve pistons 11 of the valves 10 are lifted so as to open those valves. In doing so, compressed gas that acts on the inclined ring surfaces 13 enables the valves 10 to open quickly. Since each of the valves 10 connects to the control valves 16 through controlling pipes, if the control valves 16 can be controlled independently of one another, compressed gas will be blown from specific compressed gas openings 7 to the parts of the molding sand to cause a predetermined degree of compression.

For example, it is feasible, by program control, to determine the compression process by predetermining the position, the lengths of time, and sequence of the flows of compressed gas from the openings 7, thereby enabling purposeful compression.

The valves 10 can have different opening strokes. For example, by starting to blow compressed gas from the openings of the valves 10 having smaller opening strokes, and thereafter switching to open the valves 10 having larger opening strokes, the rising gradient of compression can be at first gradual, and then become increasingly steep.

In contrast, if the valves having a uniform opening stroke are opened one by one, the compression gradient will be linear. When all the openings are opened simultaneously to attain a high ratio of compression, it is preferable to design the compression gas pipes 9 and compression gas openings 7 to cause the rise of the compression ratio within the space in the mold.

The compressed gas blown out from the openings 7 compresses the molding sand 5. Thereafter it will be discharged through an exhaust vent 2 in the model plate 3.

After the compressed gas is discharged, squeezing members 8 of the squeezing mechanisms can be used to further compress the molding sand 5. In doing so, the squeezing members 8 will compress all the molding sand 5. In the case where compressed gas continues to be blown from the compressed gas openings 7 when the process of compression by squeezing members is carried out, it is preferable to provide squeezing members 8, each having a large surface area for compression. This is because the effect of squeezing will be greater by the additional compression from the compressed gas on a larger rear surface of the squeezing members provided by expanding the surface area.

In contrast, to carry out a uniform compression process with a relatively low degree of compression, it may be effective to eliminate the compression by the squeezing mechanisms and only use compression by gas from as many compressed gas openings 7 as possible.

As is clear from the above explanation of this invention, by using compressed gas separated by compressed gas ports, this invention controls one or a group of the compressed gas pipes that are provided on substantially the entire surface of the molding sand. The apparatus of this invention also compresses the molding sand located in areas corresponding to the compressed gas pipes by using the compressed gas blown from those pipes. Thus, different parts in the molding sand within the entire mold can be compressed to various degrees. This invention also enables various parts of the mold within the molding frames to be compressed independently.

As clear from the above, even if the mold is complex in shape, this invention can cause a most appropriate compression for appropriate parts of the mold. According to the compression degree needed, the strength of the model can be controlled to fulfill the required degree for various parts. This degree can be freely selected from a wide range of strengths provided by this invention. Therefore, releasing the mold from the model can be readily done, and damage to the protruding parts of the mold corresponding to the pocket section of the model can be certainly avoided. These are the superior effects provided by this invention, and they will have a large impact in the industry this invention belongs to.

What is claimed:

1. A method of compacting molding sand in producing a sand mold by using a pattern plate provided with a pattern thereon and a plurality of vent holes therein around the pattern, comprising the steps of:

placing a flask on the pattern plate at a location outside the vent holes;

introducing molding sand into the flask;

disposing a plurality of compressed gas guiding pipes each having a lower end opening above a top surface of the molding sand introduced into the flask such that lower end openings of the gas guiding pipes face the top surface of the molding sand in the flask, each of the gas guiding pipes being capable of discharging from its lower end opening a gas flow having a pressure that is controllable independently from the pressure of the gas flow discharged from each other one of the gas guiding pipes; and discharging gas flows from the lower end openings of the gas guiding pipes such that each of the gas flows has an independently controlled pressure, to cause the gas flows to pass through the molding sand in the flask and through the vent holes, thereby compacting said molding sand in the flask with a degree of compaction that is independently controlled at each of at least two horizontally spaced locations of said molding sand, wherein each of the horizontally spaced locations of the molding sand is below a different one of the gas guiding pipes.

2. The method of claim 1, wherein at least one of the gas flows discharged from the lower end openings of the gas guiding pipes has at least one of a different pressure-increasing gradient, a different pressure, and a different flow rate than does at least one other one of said gas flows.

3. The method of claim 1, also comprising the step of: further compacting the molding sand in the flask by pressing at least one squeeze member against the molding sand after said molding sand has been compacted by the gas flows discharged from the lower end openings of the gas guiding pipes.

4. The method of claim 1, also comprising the step of:

further compacting the molding sand in the flask by pressing a plurality of squeeze members against the molding sand after said molding sand has been compacted by the gas flows discharged from the lower end openings of the gas guiding pipes, wherein the squeeze members are positioned between the top surface of the molding sand and the lower end openings of the gas guiding pipes.

5. The method of claim 4, wherein the step of further compacting the molding sand in the flask includes the step of independently controlling the pressure exerted on the molding sand by each of the squeeze members.

* * * * *